United States Patent [19]

Anzai

[11] 4,116,170

[45] Sep. 26, 1978

[54] ELECTRONIC CLOSED LOOP CONTROL SYSTEM FOR INTERNAL COMBUSTION ENGINE

[75] Inventor: Makoto Anzai, Yokosuka, Japan

[73] Assignee: Nissan Motor Company, Limited, Japan

[21] Appl. No.: 719,332

[22] Filed: Aug. 31, 1976

[30] Foreign Application Priority Data

Sep. 1, 1975 [JP] Japan ..... 50-119265[U]

[51] Int. Cl.[2] ..... F02B 3/00; F02M 7/00

[52] U.S. Cl. ..... 123/32 EE; 60/276; 60/285

[58] Field of Search ..... 123/32 EE, 119 EC; 60/276, 285

[56] References Cited

U.S. PATENT DOCUMENTS

| | | | |
|---|---|---|---|
| 3,875,907 | 4/1975 | Wessel et al. | 123/32 EE |
| 3,939,654 | 2/1976 | Creps | 60/276 |
| 3,949,551 | 4/1976 | Eichler et al. | 60/276 |
| 3,973,529 | 8/1976 | Wessel et al. | 123/32 EE |

*Primary Examiner*—Ronald B. Cox

[57] ABSTRACT

A clamping circuit is provided between a differential signal generator (such as a differential amplifier or a comparator) and a control signal generator (such as an integrator and/or a proportional amplifier) of an electronic closed loop control system for controlling an air-fuel ratio of the air-fuel mixture supplied to an internal combustion engine. The clamping circuit generates a signal whose maximum and maximum levels are symmetrical with respect to the half value of a potential of a d.c. power source provided for the clamping circuit.

3 Claims, 8 Drawing Figures

ELECTRONIC CLOSED LOOP CONTROL SYSTEM FOR INTERNAL COMBUSTION ENGINE

This invention relates in general to an electronic closed loop air-fuel ratio control system, and particularly to such a control system which controls an air-fuel ratio of the air-fuel mixture supplied to an internal combustion engine based on a signal representative of a sensed concentration of a component in exhaust gas.

Various systems have been proposed to optimally control the air-fuel ratio of the air-fuel mixture to an internal combustion engine in dependence of the modes of engine operation, one of which is to utilize the concept of an electronic closed loop control system based on a sensed concentration of a component (such as CO, $CO_2$, HC, $NO_x$ and $O_2$, etc) in exhaust gases from the engine.

FIG. 1 illustrates schematically an example of a conventional electronic closed loop control system. An exhaust gas sensor 3 is provided in an exhaust gas pipe 2 extending from an internal combustion engine 1. The exhaust gas sensor 3 senses a concentration of a component in exhaust gases to generate a signal representative thereof. A differential signal generator 4 (a differential amplifier or comparator) is connected to the sensor 3 to receive the signal therefrom. The signal thus received is compared, in the generator 4, with a reference signal which is fed through a terminal 8 to the generator 4 or which is generated in the generator 4 itself. Thus, the generator 4 generates a signal representative of a differential between the signal from the sensor 3 and the reference signal. The signal from the generator 4 is then fed to the next stage, viz., a control signal generator 5 which usually includes a conventional *p-i* (proportional-integral) controller and a pulse generator. The provision of the *p-i* controller, as is well known in the art, is to improve the efficiency of the electrical closed loop control system, in other words, to facilitate a rapid transient response of the system in question. The *p-i* controller feeds a signal to the pulse generator which generates a pulsating signal in order to control an actuator 6 (for example, an electromagnetic valve). Thus, the air-fuel ratio of the air-fuel mixture fed to the engine 1 is regulated by controlling the amount of fuel and/or air through the actuator 6.

In the above, the magnitude of the reference signal is previously determined in due consideration of optimum air-fuel ratio of the air-fuel mixture supplied to the engine 1 for maximizing the efficiency of a catalytic converter 7 or a reactor (not shown) provided in the exhaust gas pipe 2 downstream of the sensor 3. In this instance, when a so-called three way catalytic converter is employed, the air-fuel ratio is maintained in the vicinity of stoichiometric air-fuel ratio. This is because the efficiency of the three-way catalytic converter is maximized at that air-fuel ratio. A three-way catalytic converter, as is well known, as a characteristic of deoxidizing $NO_x$ and oxidizing both CO and HC at the same time.

FIG. 2 illustrates an example of a conventional circuit configuration of the differential signal generator 4 in FIG. 1. Since the circuit of FIG. 2 has been known in the art, detailed description thereof will be omitted in the following. The signal from the sensor 3 is supplied to the differential signal generator 4 through a terminal 9, on the other hand, the reference signal is also supplied to the same through a terminal 8. The terminal 8 is connected to the base of a transistor 20 the emitter of which is connected to the base of a transistor 21 and the collector thereof to the ground. The emitter of the transistor 21 is connected through a suitable resistor 24 to the d.c. power source (not shown) coupled to a terminal 25 and the collector thereof is connected to the ground through a forwardly provided diode 26. Whilst the terminal 9 is connected to the base of a transistor 22 the collector of which is connected to the ground and the emitter thereof is directly connected to the base of a transistor 23. The emitter of the transistor 23 is connected to the terminal 25 through the resistor 24 and the collector thereof is connected to the collector of a transistor 27 whose emitter is connected to the ground. The base of the transistor 27 is connected to a junction between the collector of the transistor 21 and the anode of the diode 26. The transistors 20, 21, 22, and 23 form a differential amplifier, so that these transistors are selected to have substantially equal characteristic with one another. As shown, the collector of the transistor 27 is connected to the base of a transistor 29. The collector of the transistor 29 is connected to the ground and the emitter thereof to both the base of a transistor 35 and the terminal 25 through a resistor 28. The collector of the transistor 35 is connected to the terminal 25 and the emitter thereof directly to the base of a transistor 36. The emitter of the transistor 36 is connected to the ground and the collector thereof to the bases of transistors 39, 42, and also connected to the terminal 25 through a resistor 37. The transistors 29, 35 and 36 are provided to amplify the signal current. The collector of the transistor 39 is connected to the terminal 25 and the emitter thereof to the base of a transistor 40. The collector of the transistor 40 is connected to the terminal 25 and the emitter thereof to the emitter of a transistor 42 through a resistor 41. The transistors 39 and 40 form a so-called Darlington amplifier. The collector of the transistor 42 is connected to the ground. An output terminal 10 is connected to the emitter of the transistor 42, from which terminal the control signal generator 5 derives the signal indicative of the differential between the two signals supplied to the generator 4 through the terminals 8 and 9.

In such a differential signal generator as shown by reference numeral 4, usually only one d.c. power supply (the potential of which is assumed to be $V_{cc}$) is employed, in the case of which the potential $V_{cc}$ is determined to be the maximum of the output signal from the generator and the potential "zero" to be the minimum and the half valve of $V_{cc}$ is determined to correspond to the case where a signal fed to the differential signal generator is equal to a reference one.

However, in the circuit of FIG. 2, the maximum potential of its output signal is not equal to $V_{cc}$ but to $V_{cc}-2V_{BE}$, and the minimum potential becomes $V_{BE}$, where $V_{BE}$ is a voltage drop between the base and the emitter of each of the transistors 39, 40 and 42. Therefore, as shown in FIG. 3, the potential difference between the maximum and $\frac{1}{2}V_{cc}$ is no longer identical to that between $\frac{1}{2}V_{cc}$ and the minimum. This unbalance with respect to the half value of $V_{cc}$ may invite an undesirable phenomenon in a stage which follows the control signal generator 5. That is, when an integrating circuit of FIG. 4, which consists of a resistor 5' and a capacitor 5'', is connected to the differential signal generator 4, the charging and the discharging time of the integrating circuit 5 is not equal to each other, so that the change in signal magnitude from the sensor 3 is no longer employed for precise control of the air-fuel ratio of the air-fuel mixture.

In order to avoid the above described defect, a circuit as shown in FIG. 5 has been proposed which makes equal the charging and the discharging time in question. In FIG. 5, four resistors 50 to 53 are connected in series between the d.c. power source ($V_{cc}$) and the ground, supplying the bases of transistors 54 and 55 with predetermined potential in order that the transistor 54 and 55 are respectively rendered conductive when the signal from the differential signal generator 4 is lower and higher than the half value of $V_{cc}$. As shown, two variable resistors 56 and 57 are respectively connected to the collectors of the transistors 54 and 55. The resistances of the variable resistors 56 and 57 are adjusted to make equal the charging and the discharging time of a capacitor 58, Thus, a properly integrated signal is derived from a terminal 59.

However, the circuit of FIG. 5 is not preferable in that, due to the provision of the two variable resistors to be precisely adjusted, the circuit is not suitable for mass production and complicated in configuration.

In order to remove the above described defect, in accordance with the present invention, an improved circuit is provided between the differential signal generator 4 and the control signal generator 5. This circuit clamps the signal from the generator 4 to supply the generator 5 with a signal the maximum and the minimum levels of which are symmetrical with respect to the half value of the potential of a d.c. power source provided for the circuit.

It is therefore an object of the present invention to provide an improved circuit which can remove the above described defect with a simple configuration and which is suitable for mass production.

Additional objects as well as features and advantages of the invention will become evident from the detailed description set forth hereinafter when considered in conjunction with the accompanying drawings, wherein like parts in each of the several figures are identified by the same reference numerals and characters, and wherein.

Figure 6A:
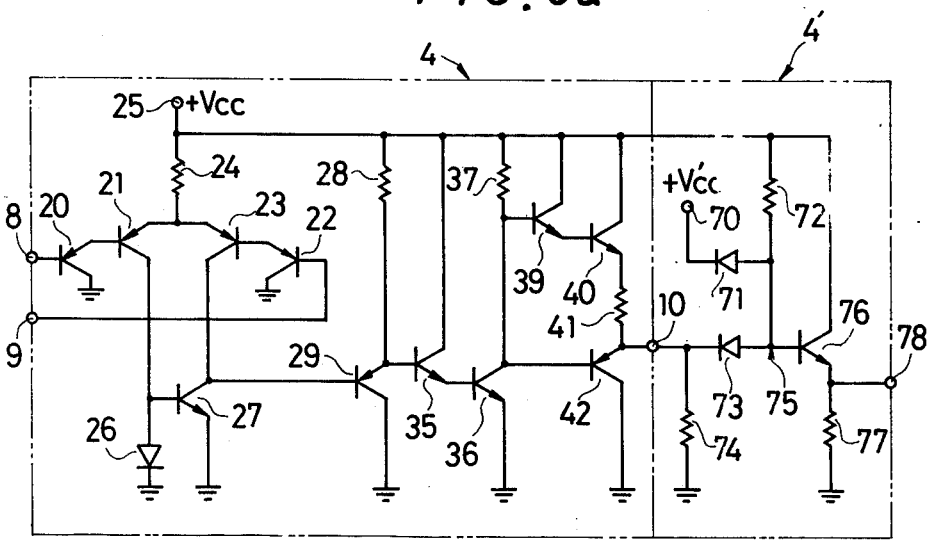
Figure 6B:
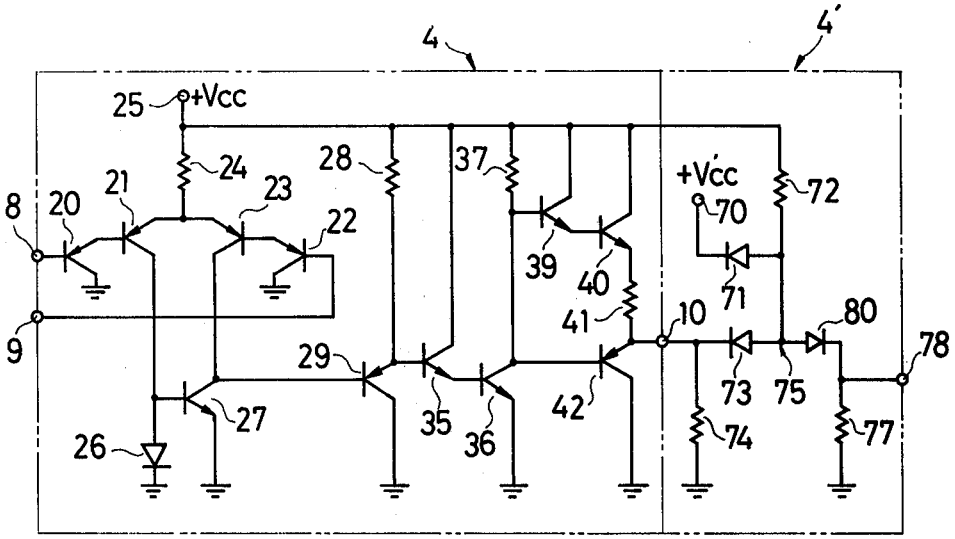
Figure 7:
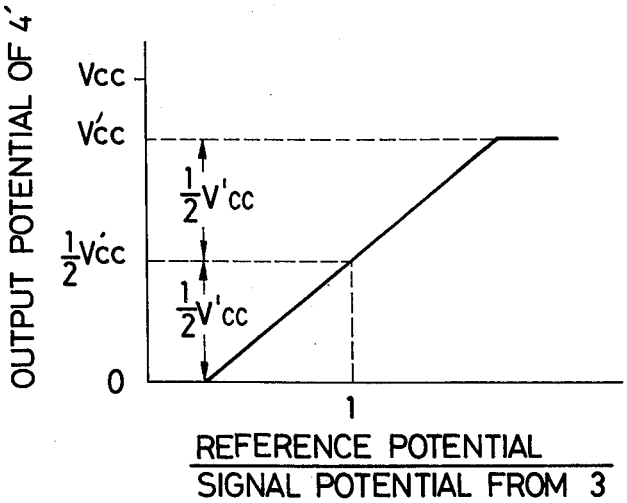

FIGS. 6*a* and 6*b* each illustrates an improved circuit embodying the present invention together with its peripheral circuit; and FIG. 7 is a graph showing output voltage of the circuit of FIG. 6*a* or 6*b* as a function of an input voltage thereto.

FIG. 6*a* illustrates a circuit 4' embodying the present invention, together with the conventional differential signal generator 4. A d.c. power source (not shown, the potential of which is $V_{cc}'$) is connected to the cathode of a diode 71 through a terminal 71. The potential $V_{cc}'$ is determined to be lower than the potential $V_{cc} - 2V_{BE}$. This potential $V_{cc}'$ can be readily obtained by dividing $V_{cc}$ by means of a suitable voltage divider. The anode of the diode 71 is connected to the terminal 25 through a resistor 72 and to a junction 75 between the anode of a diode 73 and the base of a transistor 76. The cathode of the diode 73 is connected to both the output terminal 10 of the differential signal generator 4 and one end of a resistor 74. The other end of the resistor 74 is connected to the ground. The collector of the transistor 76 is directly connected to the terminal 25 and the emitter thereof to the ground through a resistor 77. An output terminal 78 is connected to the emitter of the transistor 76 for deriving the output signal from the circuit 4'.

With this arrangement, when the potential appearing at the terminal 10 is larger than $V_{cc}'$, the diode 71 is rendered conductive with the diode 73 nonconductive. As a result, the potential at the junction 75 is $V_{cc}' + V_{D1}$, where $V_{D1}$ is a forward voltage drop across the diode 71. This means that the potential at the terminal 78 is equal to the potential $V_{cc}'$, because the voltage drop between the base and the emitter of the transistor 76 is substantially equal to $V_{D1}$ so that $V_{D1}$ and $V_{BE}$ are cancelled each other. Thus, the maximum of the signal from the terminal 78 is $V_{cc}'$ as shown in FIG. 7.

On the other hand, when the potential at the terminal 10 is lower than $V_{cc}'$, the diode 73 is in turn rendered conductive with the diode 71 nonconductive. Therefore, the potential at the junction 75 is the potential at the teminal 10 plus $V_{D2}$, where $V_{D2}$ is a forward voltage drop across the diode 73. This means that the potential at the terminal 78 is equal to the potential at the terminal 10, because the voltage drop between the base and the emitter of the transistor 76 ($V_{BE}$) is substantially equal to $V_{D2}$, so that $V_{D2}$ and $V_{BE}$ cancel each other.

In the circuit of FIG. 6*a*, the purpose of the resistor 74 is to lower the minumum value of the signal from the terminal 78 to about zero. To this end, the resistance of the resistor 74 is determined to be much smaller than that of the resistor 72 (for example, 1:100), and also smaller than impedence of the transistor 40 when it is nonconductive.

If the resistor 74 is not provided, the minimum value of the signal from the terminal 78 is about $V_{BE}$. This is because, when the diode 73 is conductive (that is, the potential at the terminal 10 is lower than $V_{cc}'$), a current flows through the resistor 72, the diode 73, and the transistor 42, with the result that the potential at the terminal 10 is about $V_{BE}$.

FIG. 7 illustrates the potential appearing at the terminal 78 as a function of the potential of the signal from the sensor 3. As shown, the maximum potential of the signal is $V_{cc}'$, and the minimum is substantially zero, and the maximum and the minimum levels are symmetrical with respect to $\frac{1}{2}V_{cc}'$.

Figure 1:
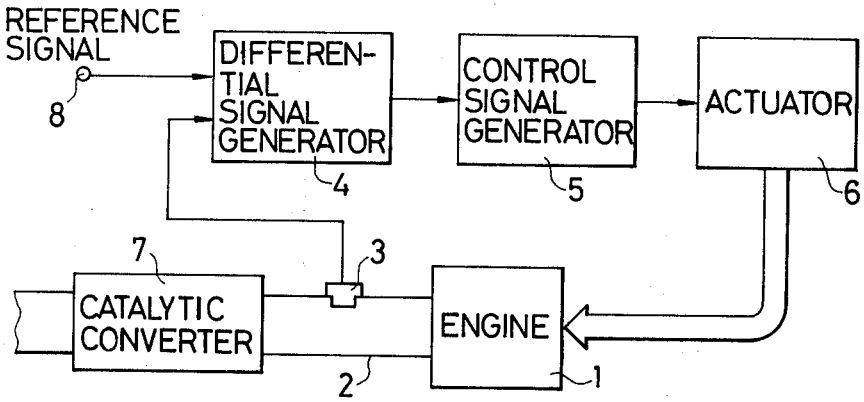
FIG. 1 PRIOR ART
FIG. 1 is a schematic block diagram of an electronic closed loop control system for an air-fuel ratio of the air-fuel mixture supplied to an internal combustion engine, with which the present invention is concerned.
Figure 2:
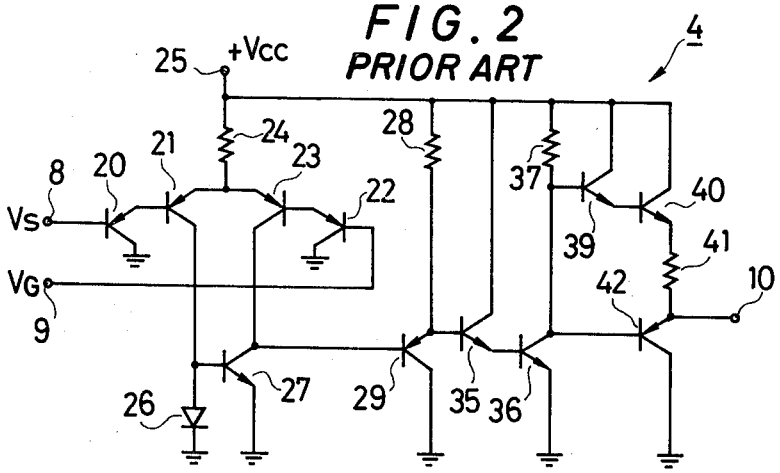
FIG. 2 PRIOR ART
FIG. 2 is an example of a conventional electronic circuit used in the system of FIG. 1.
Figure 3:
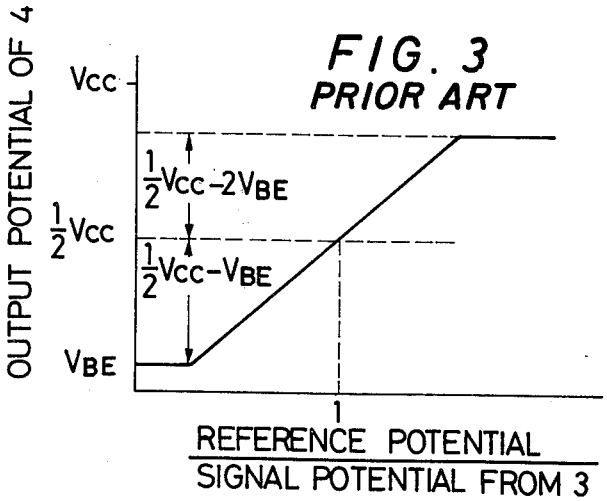
FIG. 3 PRIOR ART
FIG. 3 is a graph showing output voltage of the circuit of FIG. 2 as a function of an input voltage thereto.
Figure 4:
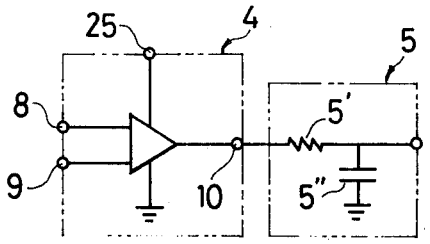
FIG. 4 PRIOR ART
FIG. 4 illustrates an example of a conventional circuit used in FIG. 1.
Figure 5:
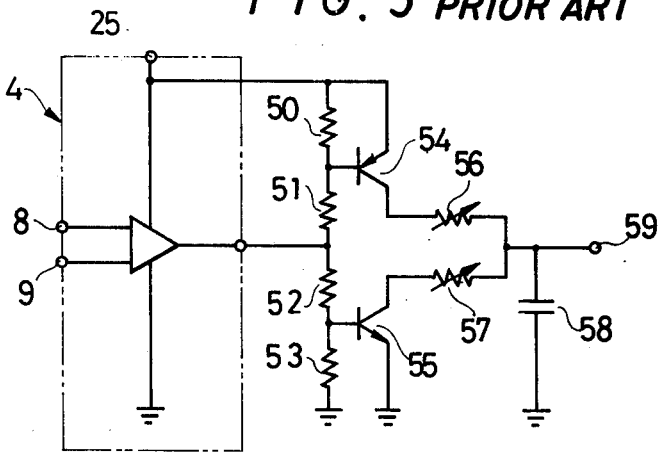
FIG. 5 PRIOR ART
FIG. 5 illustrates an example of a conventional circuit used in FIG. 1.

Therefore, due to the provision of the circuit 4' of FIG. 6*a*, the simple integrating circuit in FIG. 4 can be utilized without adversely affecting the precise control of the electronic closed loop control system in question.

In the circuit of FIG. 6*a*, the transistor 76 can be replaced by a diode 80 as shown in FIG. 6*b*.

It is understood from the foregoing that, in accordance with the present invention, the control signal generator 5 can receive a signal, the maximum and the minimum values of which are symmetrical with respect to the half value of the potential of the d.c. power source provided for the clamping circuit. As a result, as the control signal generator 5, a simple circuit can be used thereby to simplify the control system with the advantage of suitability for mass production.

What is claimed is:

1. An electronic closed loop control system for controlling an air-fuel ratio of the air-fuel mixture supplied to an internal combustion engine (1), which system includes: and exhaust gas sensor (3) for sensing a component of exhaust gases to generate an electrical signal representative thereof, a differential signal generator (4) fed by a source of single polarity and connected to said exhaust gas sensor for generating an electrical signal representative of a differential value between the signal from the sensor and a reference signal, control means (5) connected to the differential signal generator, and an actuator (6) connected between said control means and the engine, said control means controlling said actuator depending upon said differential value to optimally regulate the air-fuel ratio of the air-fuel mixture, wherein said electronic closed loop control system further comprises: clamping means (4') for clamping the signal from said differential signal generator to generate a signal therefrom, said clamping means being electrically interposed between said differential signal generator and said control means and including a first d.c. power source the potential of which is lower than that of a second d.c. power source provided for the differential signal generator, the potential of the signal from said clamping means ranging substantially from that of said first d.c. power source and zero potential, and the middle value of the signal from said clamping means substantially corresponding to the case where the potential of the signal from the sensor is equal to that of said reference signal.

2. An electronic closed loop control system claimed in claim 1, in which said clamping means includes; a first diode (71) the cathode of which is connected to said first d.c. power source, a second diode (73) the cathode of which is connected to said differential signal generator, the anode of said second diode being connected to the anode of said first diode and also being connected to said second d.c. power source through a first resistor (72), a second resistor (74) connected between the cathode of said second diode and the ground, the resistance of said second resistor being considerably low relative to that of said first resistor, a transistor the base of which is connected to the anode of said second diode and the collector thereof to said second d.c. power source and the emitter thereof connected to the ground through a third resistor (77), and an output terminal connected to the emitter of said transistor.

3. An electronic closed loop control system claimed in claim 1, in which said clamping means includes; a first diode (71) the cathode of which is connected to said first d.c. power source, a second diode (73) the cathode of which is connected to said differential signal generator, the anode of said second diode being connected to the anode of said first diode and also being connected to said second d.c. power source through a first resistor (72), a second resistor (74) connected between the cathode of said second diode and the ground, the resistance of said second resistor being considerably low relative to that of said first resistor, a third diode the anode of which is connected to the anode of said second diode and the cathode thereof to the ground through a third resistor (77), and an output terminal connected to the cathode of said third diode.

* * * * *